US010446917B1

(12) United States Patent
Bonebright et al.

(10) Patent No.: US 10,446,917 B1
(45) Date of Patent: Oct. 15, 2019

(54) DEFORMABLE MAGNETIC ANTENNAS

(71) Applicant: General Atomics, San Diego, CA (US)

(72) Inventors: Mark Eugene Bonebright, El Cajon, CA (US); Mark William Covington, San Diego, CA (US); Jeffrey Howard Caton, Escondido, CA (US)

(73) Assignee: General Atomics, San Diego, CA (US)

( * ) Notice: Subject to any disclaimer, the term of this patent is extended or adjusted under 35 U.S.C. 154(b) by 171 days.

(21) Appl. No.: 15/368,589

(22) Filed: Dec. 3, 2016

(51) Int. Cl.

| | |
|---|---|
| ***H01Q 1/00*** | (2006.01) |
| ***H01Q 1/27*** | (2006.01) |
| ***H01Q 1/22*** | (2006.01) |
| ***H01Q 5/22*** | (2015.01) |

(52) U.S. Cl.
CPC ..... *H01Q 1/273* (2013.01); *H01Q 1/2291* (2013.01); *H01Q 5/22* (2015.01)

(58) Field of Classification Search
CPC .. H01Q 7/08; H01Q 1/38; H01Q 3/44; H01Q 9/145; H01Q 9/30
USPC ..... 343/787, 745, 850, 771
See application file for complete search history.

(56) References Cited

U.S. PATENT DOCUMENTS

| | | | | |
|---|---|---|---|---|
| 8,686,918 | B1 | 4/2014 | Diaz | |
| 8,773,312 | B1 | 7/2014 | Diaz | |
| 8,847,840 | B1 | 9/2014 | Diaz | |
| 8,847,846 | B1 | 9/2014 | Diaz | |
| 2004/0208411 | A1* | 10/2004 | Sharma | H04B 10/508 385/1 |
| 2006/0022886 | A1* | 2/2006 | Hein | B82Y 25/00 343/787 |
| 2010/0015918 | A1* | 1/2010 | Liu | H04B 5/00 455/41.1 |
| 2014/0247148 | A1* | 9/2014 | Proud | H02J 7/025 340/870.02 |

* cited by examiner

*Primary Examiner* — Dameon E Levi
*Assistant Examiner* — Collin Dawkins
(74) *Attorney, Agent, or Firm* — Perkins Coie LLP

(57) ABSTRACT

Deformable magnetic antennas are provided to include a plurality of flexible magnetic antenna layers stacked to form a layered magnetic antenna structure that is bendable. Each flexible magnetic antenna layer includes a magnetic material that confines a magnetic field to concentrate a magnetic flux of the magnetic field inside the magnetic antenna layer. A lubricating material is applied between adjacent flexible magnetic antenna layers to allow adjacent magnetic layers to move relative to one another when the layered magnetic antenna structure is bent so as to reduce a stress in each flexible magnetic antenna layer caused by bending the layered magnetic antenna structure.

21 Claims, 6 Drawing Sheets

DEFORMABLE MAGNETIC ANTENNAS

TECHNICAL FIELD

The present disclosure relates to magnetic antennas for wireless communications.

BACKGROUND

Electronic communication devices require one or more antennas to receive incoming communication signals or transmit signals to other devices or systems. The size and shape of an antenna affects the frequency of operation as well as an associated gain, beam shape and other parameters.

SUMMARY

The disclosed technology in this disclosure can be used to construct deformable magnetic antennas that receive or transmit magnetic fields of antenna signals. Due to the magnetic nature of the disclosed magnetic antennas, they can be used in a wide range of communications applications like electrically conductive antennas that receive or transmit electrical fields of antenna signals, and provide advantageous antenna operations and performance that are superior to the electrically conductive antennas such as compact sizing, wide operating bandwidths and high efficiency of magnetic antennas, or to offer antenna operations in environments where operations of electrically conductive antennas may be compromised or impossible, such as in water, wet weather conditions, or surroundings with electrically conducting objects or surfaces. The deformable properties of the disclosed antennas are based on multi-layer designs of magnetic antenna materials that are movable relative to one another to enable the disclosed antennas to be shaped or bent to fit into various communication device configurations while maintain the antenna structural integrity over the repeated uses over time and offering superior antenna operation performance, including, for example, wearable magnetic antennas carried or worn by users.

As a specific example, in mobile communications applications, the antenna must be transported with the communications transmitter and/or receiver. Mobile communications devices may have additional requirements such as limitations in size, weight, and power. Because a larger antenna may be used to achieve a higher e gain than a smaller antenna based on the same antenna technology to reduce the power needed to communicate to a particular range, larger antennas may be favored for mobile applications. But, many mobile applications require small sized systems as well pushing toward smaller antennas. Additional antenna options are needed to satisfy the wide array of commercial, consumer, and military communications needs including providing relatively compact and light weight wearable antennas. The disclosed deformable magnetic antennas can be configured in ways that meet those and other application requirements.

More specifically, the disclosed technology can be implemented to construct a deformable magnetic antenna that includes, for example, a plurality of flexible magnetic antenna layers stacked to form a layered magnetic antenna structure that is bendable. Each flexible magnetic antenna layer includes a magnetic material that confines a magnetic field to concentrate a magnetic flux of the magnetic field inside the magnetic antenna layer. A lubricating material is applied between adjacent flexible magnetic antenna layers to allow adjacent magnetic layers to move relative to one another when the layered magnetic antenna structure is bent so as to reduce a stress in each flexible magnetic antenna layer caused by bending the layered magnetic antenna structure.

The details of one or more variations of the subject matter described herein are set forth in the accompanying drawings and the description below. Other features and advantages of the subject matter described herein will be apparent from the description and drawings, and from the claims.

BRIEF DESCRIPTION OF THE DRAWINGS

When practical, similar reference numbers denote similar structures, features, or elements.

DETAILED DESCRIPTION

Figure 1:
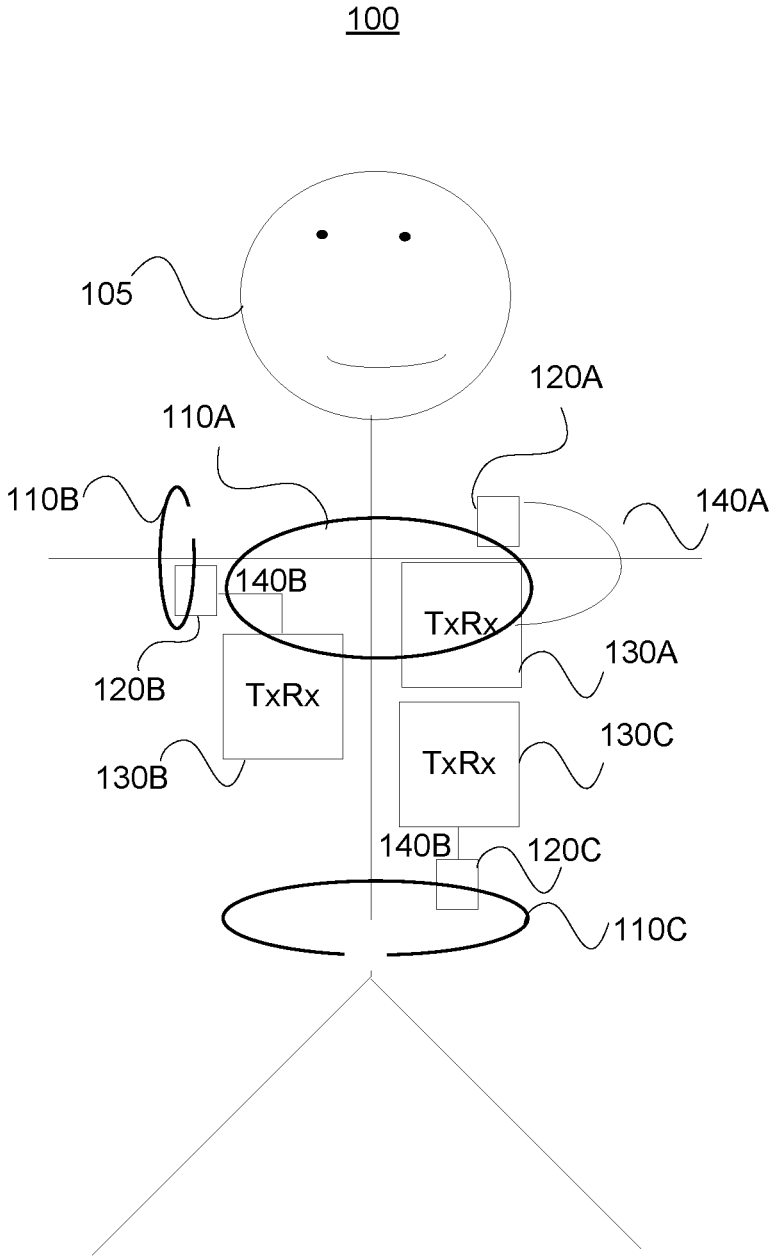
FIG. 1 depicts examples of wearable magnetic antennas coupled to communications transceivers, in accordance with some example embodiments

Wearable magnetic antennas are magnetic antennas that may be worn by a person or may be conformably attached to an object such as a mast, tree, or other fixed or movable object. A wearable antenna may be flexible to conform to the wearer or to the object. For example, a wearable antenna may be configured as a belt worn by a person. The wearable antenna may have one or more electrical connections to allow transfer of energy to and from the antenna. For example, a wearable antenna may receive electromagnetic energy via the magnetic field from a distant source, and the received energy may be converted into, for example, a received electrical antenna signal which may be further conducted to a receiver for processing via a cable such as a coaxial cable. A wearable antenna may transmit electromagnetic energy from a transmitter connected to the wearable antenna via a cable such as a coaxial cable. The wearable antenna may be used to transmit an electromagnetic signal, receive another electromagnetic signal, or both at the same or different times. Such a wearable antenna may be shaped in to a desired wearable item or integrated as part of clothing to be worn by a person. A wearable antenna may be configured to be worn at any one of suitable locations on a person. For example, a wearable antenna may be configured to be worn as a belt, worn as an armband, worn on a vest, or worn on or inside a hat, and so on.

In some example embodiments, a wearable antenna may be configured to couple energy to/from a radiated magnetic field and may be referred to as a magnetic antenna. A wearable magnetic antenna coupled via a cable to a transmitter may convert a current from the transmitter to an oscillating magnetic field at the antenna that carries the antenna transmission signal. The oscillating magnetic field may give rise to an radiating electromagnetic field resulting in a transmitted electromagnetic wave. A wearable magnetic antenna coupled via a cable to a receiver may convert a magnetic field incident on the antenna to a current that is that is detected by a receiver.

In some example embodiments, a wearable magnetic antenna may be configured to include a magnetic material. The magnetic material may confine and concentrate the magnetic flux inside the material. In some implementations, a suitable magnetic material may be a compound having a relative permeability greater than one. In some implementations, a suitable magnetic material may be a ferromagnetic material engineered to achieve certain desired material properties based on the requirements of particular antenna applications. For example, the magnetic material can be structured to exhibit a relatively high magnetic permeability μ. The magnetic permeability, μ, includes two parts: an imaginary permeability μ" and a real permeability μ'. A material with a small imaginary permeability μ" tends to improve the antenna efficiency. A suitable ferromagnetic material structure for implementing the disclosed technology may be configured to have different magnetic permeability properties, μ. For example, in some applications, the real permeability (μ') may be less than the imaginary permeability (μ"). In other applications, the real permeability (μ') may be greater than the imaginary permeability (μ"). When μ'>μ", the antenna structure may also have a real permittivity (ε') greater than an imaginary permittivity (ε"). In some applications, the real part of the electromagnetic constitutive property can be significantly greater than a corresponding imaginary part of the electromagnetic constitutive property. For example, the real part of the electromagnetic constitutive properties may be three, five, tens, or even hundreds of times greater than the corresponding imaginary electromagnetic constitutive property. A higher real part of electromagnetic constitutive property may be used advantageously to reduce the cross-section dimension of the structure. Material compositions that have the real part of the electromagnetic constitutive property that is greater than a corresponding imaginary part of the electromagnetic constitutive property (e.g., real permittivity (ε')>imaginary permittivity (ε"); or real permeability (μ')>imaginary permeability (μ")), may be referred to as a pseudo-conductor material as described in U.S. Pat. Nos. 8,773,312B1; 8,847,840B1; 8,847,846B1 and 8,686,918B1 that are granted to Rodolfo E. Diaz and are assigned to General Atomics. The above-referenced four U.S. patents are incorporated by reference as part of this patent document. In other implementations, the antenna material may be engineered to achieve high bandwidth operation by increasing the ratio of the permeability to the permittivity. In this regard, various permeable materials (magnetic materials) tend to be heavy, fragile, ceramic ferrites with limited frequency capabilities. For example, manganese ferrites (μ' in the 1000's) can be utilized for some implementations in a frequency range between low KHz to low MHz range. Nickel zinc ferrites (μ' in the 100's) may provide suitable permeabilities in the VHF range. In the frequency range of 1 GHz, hexaferrites (e.g. $Co_2Z$) have sizeable permeabilities in the 10 to 30 range, but may be less efficient above the high UHF frequencies. Since many ferrite ceramics have a permittivity of the order of 10, as the GHz frequency range is approached the highest μ/ε ratio attainable by a ferrite may be on the order of 3:1 (ε~3) using aligned $Co_2Z$. As such, many of these materials, such as natural ferrites, suffer from naturally limited efficiency at bandwidths usually associated with broad loss peaks that may introduce excess loss. Materials can be engineered to have μ'>>ε' to provide wider efficiency bandwidth operations. For example, such a device can be configured to detect signals from DC to L-band frequencies without requiring a special tuning circuit to efficiently receive in the frequency band of interest.

To improve the flexibility of the wearable antenna, the magnetic material may be formed into sheets. The sheets may be stacked like the pages in a book. To further improve the flexibility of the stacked sheets, a lubricant may be applied between adjacent sheets in the stack. The lubricant may reduce friction between the sheets and improve the durability and flexibility of the stacked material compared to a solid magnetic material or stacked sheets without the lubricant.

FIG. 1 at 100 depicts examples of wearable magnetic antennas coupled to communications transceivers worn by a person. Wearable magnetic antennas are depicted in a vest at 110A, an armband at 110B, and a belt at 110C. Transducers 120A, 120B, and 120C convert magnetic flux at antennas 110A, 110B, and 110C to/from electrical signals such as current or to another signal and are sent via cables 140A, 140B, and 140C to/from transceivers 130A, 130B, and 130C.

Wearable magnetic antenna 110A may be configured as a hat, part of a vest or other configuration that may be worn on a person's torso. Wearable magnetic antenna 110B may be configured as an armband, arm cuff, or other configuration that may be worn on a person's arm. Wearable magnetic antenna 110B may be configured as a flat patch as part of a vest, shirt, or jacket. Wearable magnetic antenna 110C may be configured as a belt, waistband, part of a pair of pants, overalls, or other configuration that may be worn around a person's waist or legs. A wearable magnetic antenna may also be configured in other wearable items.

Magnetic antenna 110A/110B/110C may include sheets of a suitable magnetic material with lubricant between adjacent sheets to improve flexibility and/or durability of the magnetic antenna. The magnetic material may cause a confinement and concentration of magnetic flux in the sheets which may increase the coupling of energy to/from the transducer 120A/120B/120C and accordingly to the transceiver 130A/130B/130C. In this way, energy transfer to/from a propagating electromagnetic wave from/to transceiver 130A/130B/130C may be improved.

Transducer 120A/120B/120C may convert energy in the changing magnetic flux in magnetic antennas 110A/110B/110C to another form such as a current. For example, in a receive configuration, transducer 120A/120B/120C may convert changing flux in magnetic antenna 110A/110B/110C to a current. In some example embodiments, the transducer 120A/120B/120C may be a conductive loop wrapped around the magnetic antenna such that the magnetic flux passes through the loop. The changing magnetic flux in the antenna may induce a current in the loop that is detected by the receiver in transceiver 130A/130B/130C. In a transmit configuration, transducer 120A/120B/120C may convert a current or other quantity to a changing flux in magnetic antenna 110A/110B/110C. The transducer 120A/120B/120C may be a conductive loop wrapped around the magnetic antenna such that the magnetic flux passes through the loop. A changing current flowing in the loop may produce a changing magnetic flux in the magnetic antenna 110A/110B/110C. The current may be changing in accordance with a desired transmit signal from a transmitter in transceiver 130A/130B/130C. Other transducers may convert the magnetic flux in the magnetic antenna to a voltage or to another quantity such as an optical quantity. For example, an optical quantity such as a phase, an amplitude, or polarization rotation may be modulated by the magnetic field the magnetic antenna via the magneto-optical effect or other effect.

Transceiver 130A/130B/130C may include a receiver, a transmitter, or both a transmitter and a receiver. Transceiver 130A/130B/130C may be configured to generate/detect any type of communication signal carried by an electromagnetic wave such as a voice signal, analog information signal, or any type of digital signal such as digitized voice, digitized video, network data, Internet data or any other type of information signal. Various embodiments of the disclosed magnetic antenna may operate with transceivers 130A/130B/130C at any of a wide range of frequencies from 100 kHz to 40 GHz.

Cable 140A/140B/140C may carry a signal transduced by, or for transduction by, transducer 120A/120B/120C. For example, cable 140A/140B/140C may be an electrical cable for carrying a radio frequency current. In some example embodiments, cable 140A/140B/140C may be another type of cable such as a fiber optic cable.

Figure 2:
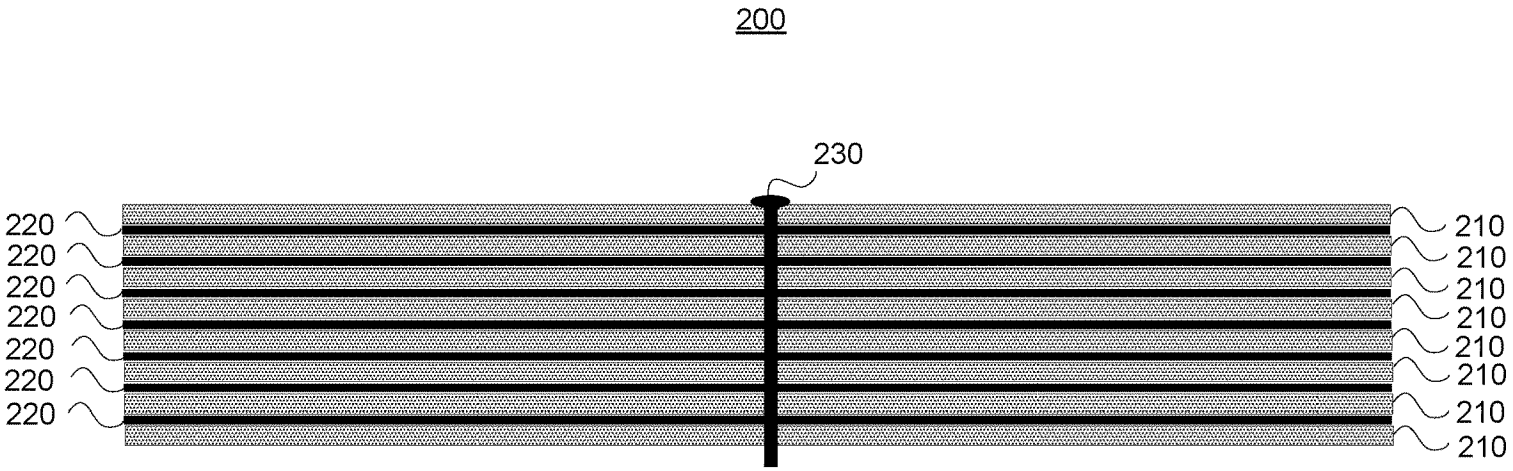
FIG. 2 depicts an example of a layered magnetic material, in accordance with some example embodiments.

FIG. 2 depicts an example of a layered magnetic material 200. Layered magnetic material 200 may include alternating magnetic material layers 210 and lubricant layers 220. An anchor device 230 may pass through the magnetic material layers and lubricant layers to fix the position of the layers at the anchor point. The description of FIG. 2 may include features described with respect to FIG. 1.

Magnetic material layers 210 may contain any type of cohesive magnetic material or non-cohesive magnetic material with a sheath or coating to hold the magnetic material in the shape of a sheet. Layered magnetic material 200 may include any number of layers 210 from two to thousands of layers. In the example of FIG. 2, eight layers are shown. Each magnetic material layer 210 may have a relative permeability, $\varepsilon_r$, that may include a real part greater than 1. The relative permeability may be expressed as a complex quantity with a real and imaginary part where the real part is related to the propagation and the imaginary part is related to the loss in the magnetic material. Layered magnetic material 200 may include layers of magnetic material with different permeabilities. For example, the permeabilities of successive layers in layered magnetic material 200 may increase in successive sheets moving from the outside layers to the inside layers. In another example, the permeabilities of successive layers in layered magnetic material 200 may decrease in successive sheets moving from the outside layers to the inside layers. In yet another example, the permeabilities of successive sheets may alternate from one value to another. Any other configuration of permeabilities on successive sheets may also be used. Various configurations may cause additional confinement of the magnetic field in the center of the layered material or other effect such as improved mechanical properties including flexibility and/or improved environmental properties.

Lubrication layers 220 may be placed between adjacent magnetic material layers 210 to reduce friction between adjacent magnetic material layers 210 to allow for relative movement between adjacent magnetic material layers 210 when being deformed to provide an overall compliant and flexible property of the overall antenna structure while reducing the mechanical stress within each individual magnetic material layer 210 and to provide a long-term durability of the antenna against undesired structural fatigue due to repeated bending or deformation during the normal use. For example, lubrication layers 220 may reduce coefficients of static and/or dynamic friction between adjacent magnetic material layers 210. By reducing the friction between magnetic material layers, the layered magnetic material 200 may be more flexible. For example, a layered magnetic material 200 can be bent around a smaller radius without causing fatigue to the layered magnetic material 200. For example, a layered magnetic material that can be bent around a 3 millimeter radius without causing fatigue may be more flexible than a layered material that cannot be bent around a radius smaller than 13 millimeters without causing fatigue. Lubrication layers 220 may include a liquid, solid, and/or powdered material. Different lubrication layers 220 may include different lubricants. Accordingly, the lubricant layers 220 in layered magnetic material 200 may include the same or different lubricants in lubricant layers 220.

Figure 3:
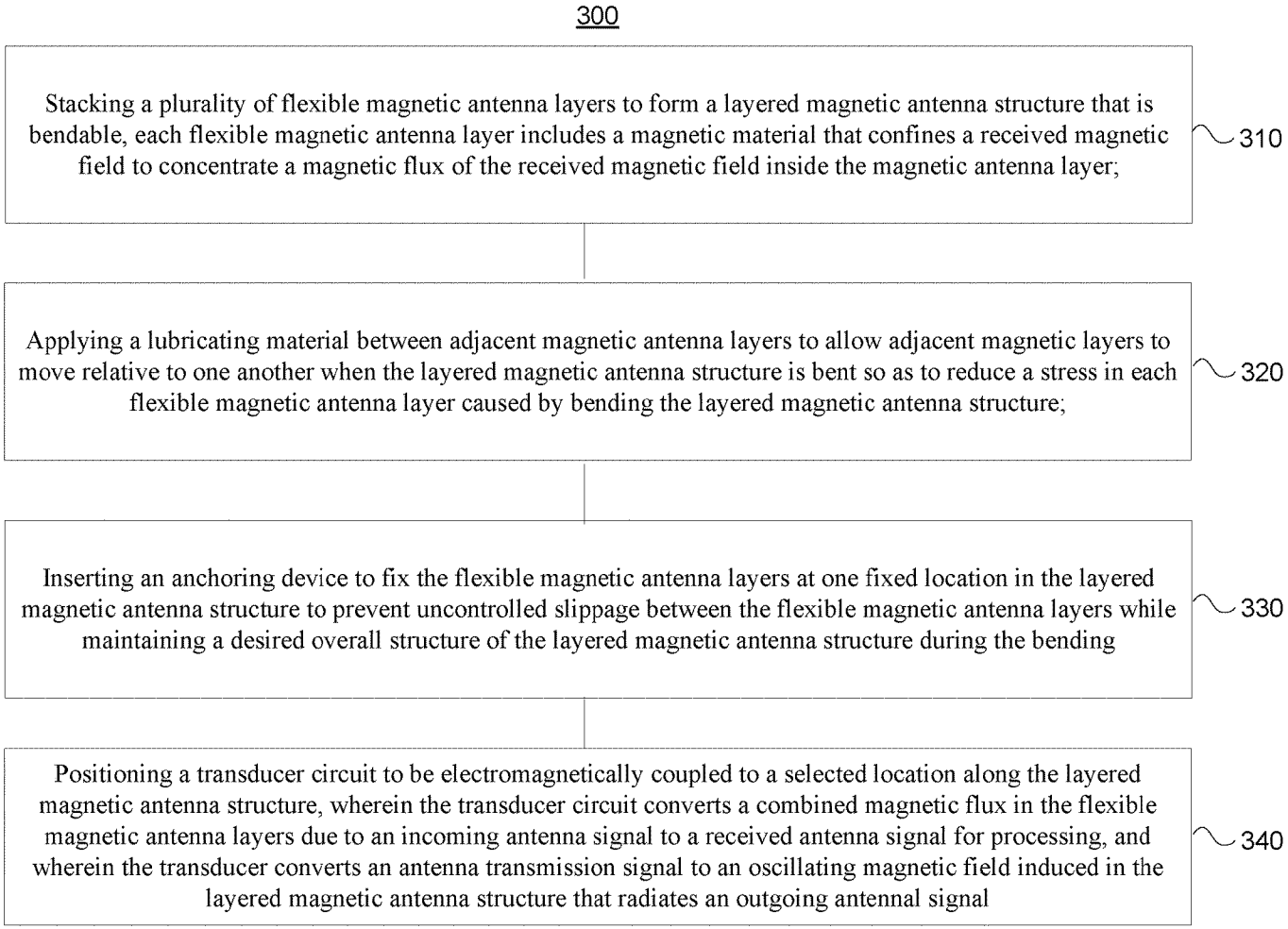
FIG. 3 depicts a process, in accordance with some example embodiments.

FIG. 3 depicts a process for producing a wearable magnetic antenna. At 310, a plurality of flexible magnetic antenna layers may be stacked. At 320, a lubricating material may be applied between adjacent flexible magnetic antenna layers. At 330, an anchoring device may be inserted to fix the flexible magnetic antenna layers at one location in the layered magnetic antenna. At 340, a transducer circuit may be positioned to receive an incoming electromagnetic signal and/or transmit an outgoing electromagnetic signal. The description of FIG. 3 may include features described with respect to FIGS. 1 and 2.

At 310, a plurality of flexible magnetic antenna layers may be stacked to form a layered magnetic antenna structure that is bendable. Each flexible magnetic antenna layer may include a magnetic material that confines a magnetic field to concentrate a magnetic flux inside the magnetic antenna layer. Different magnetic antenna layers in the plurality of magnetic antenna layers may be produced from different magnetic materials with different mechanical properties, different physical properties including different permeabilities, different dielectric constants, and/or different refractive indices. For example, the magnetic antenna layers may be chosen such that the relative permeability increases from a first in the plurality of layers to a last in the plurality of layers.

At 320, a lubricating material may be applied between adjacent flexible magnetic antenna layers. The lubricating material may allow adjacent magnetic layers in the stack to move relative to one another when the layered magnetic antenna structure is bent. The lubricating layer may reduce a stress in one or more of the magnetic antenna layers caused by bending the layered magnetic antenna structure. Different lubricating materials may be used between different layers in the stack of magnetic antenna layers.

Figure 4:
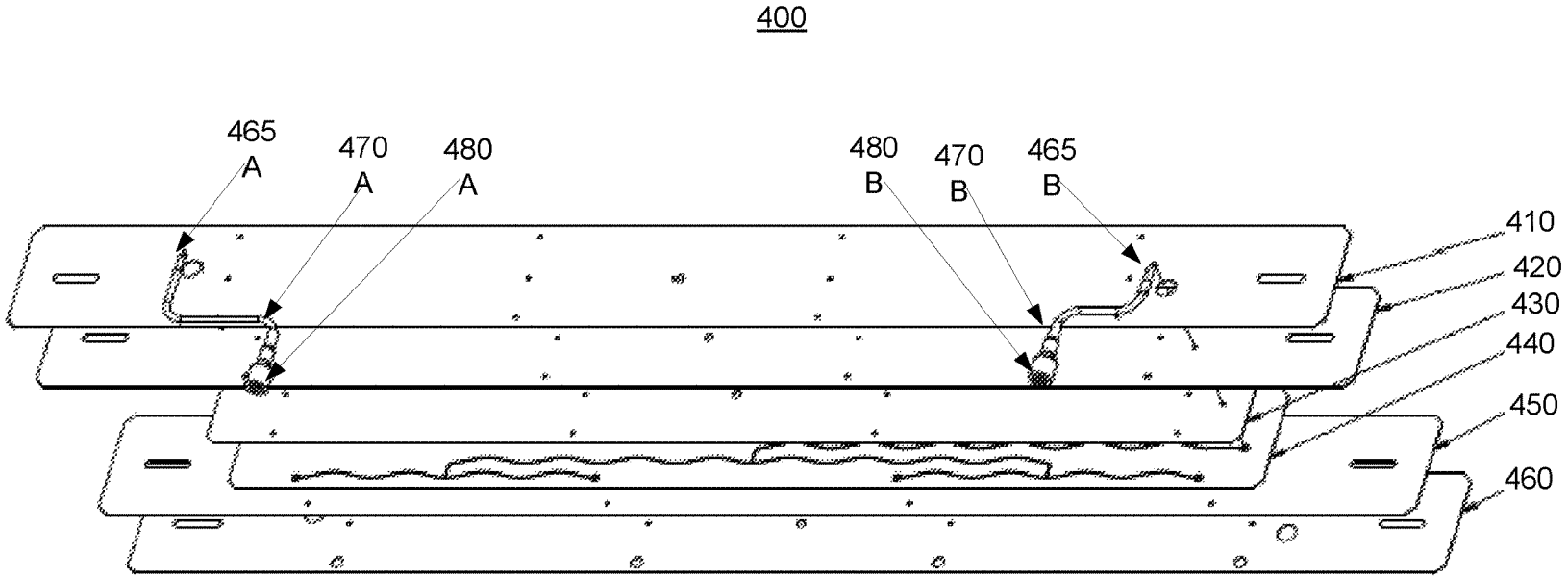
FIG. 4 depicts examples of layers in a wearable magnetic antenna, in accordance with some example embodiments.

At 330, an anchoring device may be inserted through the plurality of magnetic and lubricating layers to fix the relative positions of the flexible magnetic antenna layers at the anchoring device. The anchoring may reduce or prevent slippage between the flexible magnetic antenna layers at the anchor device while maintaining a desired overall structure of the layered magnetic antenna structure during the bending. For example, a cylindrical anchor at the center of a length of the plurality of magnetic layers and lubricating layers may pass through a circular hole in the layers. Other anchors may be inserted at each end of the length of the plurality of magnetic layers and lubricating layers. The end anchors may pass through slots (rather than circular holes) in the plurality of magnetic layers and lubricating layers. The slots may allow for some slippage at the end anchors as the length is bent. For example, as the length of magnetic antenna shown at 400 in FIG. 4 is bent, the various layers may bend at different radii as magnetic antenna 400 is bent in the shape of a belt. The layers may slide in the end slot according to the bend.

At 340, a transducer circuit may be positioned to be electromagnetically coupled to a selected location along the layered magnetic antenna structure. Used as a receive antenna, the transducer circuit may convert a combined magnetic flux in the flexible magnetic antenna layers due to an incoming electromagnetic signal to a received antenna signal for processing at a receiver. Used as a transmit antenna, the transducer may convert an antenna transmission signal from a transmitter to an oscillating magnetic field induced in the layered magnetic antenna structure. The oscillating magnetic field may radiate an outgoing signal.

FIG. 4 at 400 depicts layers in an example of a wearable magnetic antenna. For example, the wearable antenna 400 may be configured as a belt, armband, or band for inside a hat or helmet. The example at 400 includes layers 410, 420, 430, 440, 450, and 460. Layer 410 may connect thru via holes in layers 410, 420, 430, 430, 440, and 450 to layer 460, and layer 410 may connect to cables 470A and 470B. Cable 470A may connect to connector 480A and cable 470B may connect to connector 480B. The description of FIG. 4 may include features described with respect to FIGS. 1, 2, and 3.

Layer 410 of wearable antenna 400 may provide one or more antenna ports. In the example of FIG. 4, wearable antenna 400 provides two antenna ports 480A and 480B. The antenna ports may provide different signals to different transceivers, receivers, transmitters, or any combination of transmitters, receivers, and transceivers. The antenna ports 480A and 480B may operate at different frequencies and/or bandwidths. In other applications, a single antenna port may be used in a device or more than two antenna ports may be used, depending on the specific needs of the applications.

When used as a receive antenna, layer 410 may provide a signal including a current and/or voltage representative of an electromagnetic wave impinging on wearable antenna 400. The received signal may be provided from a power combining layer through one or more vias in intervening layers to a cable end. For example, a received signal may be provided from power combining layer 440 through one or more vias in intervening layers 430 and 420, to a cable end 465A, cable 470A, to connector 480A. When used as a transmit antenna, connector 480A may connect to a transmit amplifier supplying a signal for transmission. The transmit signal may pass through connector 480A, cable 470A, cable end 465A, via holes through layers 420 and 430 to power distribution layer 440. In the example of FIG. 4 at 400, the power distribution/combiner layer 440 distributes/combines signals from four conductive loops further detailed in FIGS. 5 and 6. Although FIG. 4 depicts two antenna ports and four loops whose signals are combined/distributed, any other number of antenna ports and/or loops may also be used. In some example embodiments, signals to/from more than one antenna port may be combined. For example, signals from two antenna ports may be combined into a single receive signal to be received at a receiver.

Figure 5:
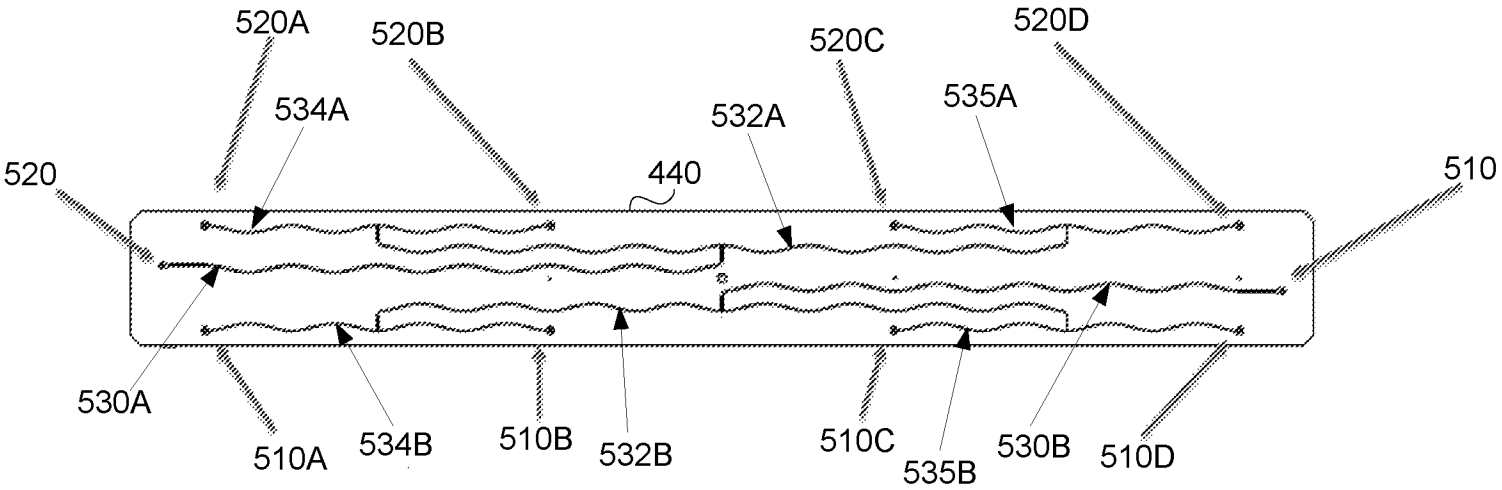
FIG. 5 depicts a power combining/distributing layer of a wearable magnetic antenna, in accordance with some example embodiments.

FIG. 5 details the power combining/distributing layer 440 shown in FIG. 4. Layer 440 includes vias 510, 510A-D, 520, 520A-D, and meandering transmission lines (also referred to herein as conductive traces) 530A-B. Layer 440 provides power distribution for a transmit signal and power combining for a receive signal. The description of FIG. 5 may include features described with respect to FIGS. 1-4.

Layer 440 includes two power distributing/combining networks corresponding to antenna ports 480A and 480B. The power distributing/combining networks include meandering conductive traces configured to traverse layer 440 along a path that meanders, or is not straight. For example, via 510 may connect a cable end at 410 such as 465B to meandering trace 530B. Meandering trace 530B may traverse 440 to a connection to meandering trace 532B. Power from 530B may be split into two paths on 532B, one to meandering trace 534B and the other to meandering trace 535B. Over a partial length, meandering trace 530B may run parallel to 532B, 534B, and/or 535B. The meandering traces may maintain parallel paths throughout the meandering as shown in FIG. 5. In some example embodiments, the meandering and parallel traces may maintain a constant impedance and/or coupling between adjacent traces thereby preventing discontinuities that may radiate or degrade the antenna performance. Each meandering trace may traverse layer 440 along a "zig-zag" path, or a sinusoidal path, or other meandering path. The meandering traces may provide more flexibility and durability for layer 440, and in turn a more flexible and durable wearable antenna 400. For example, the meandering traces 530A, 534A, and 535A may allow for some lengthwise stretching of layer 440. The meandering traces may improve durability as layer 440 is bent to form a wearable belt antenna of other wearable antenna.

Layer 440 distributes/combines one signal such as a signal from via 520 into four signals at such as 520A-D. Each of 520A-D may connect through vias to a loop or partial loop around wearable antenna 400. Similarly, layer 440 distributes/combines one signal such as a signal from via 510 into four signals at 510A-D. Each of 510A-D may connect through vias to a loop or partial loop around wearable antenna 400. The loops are further detailed in FIG. 6.

Figure 6:
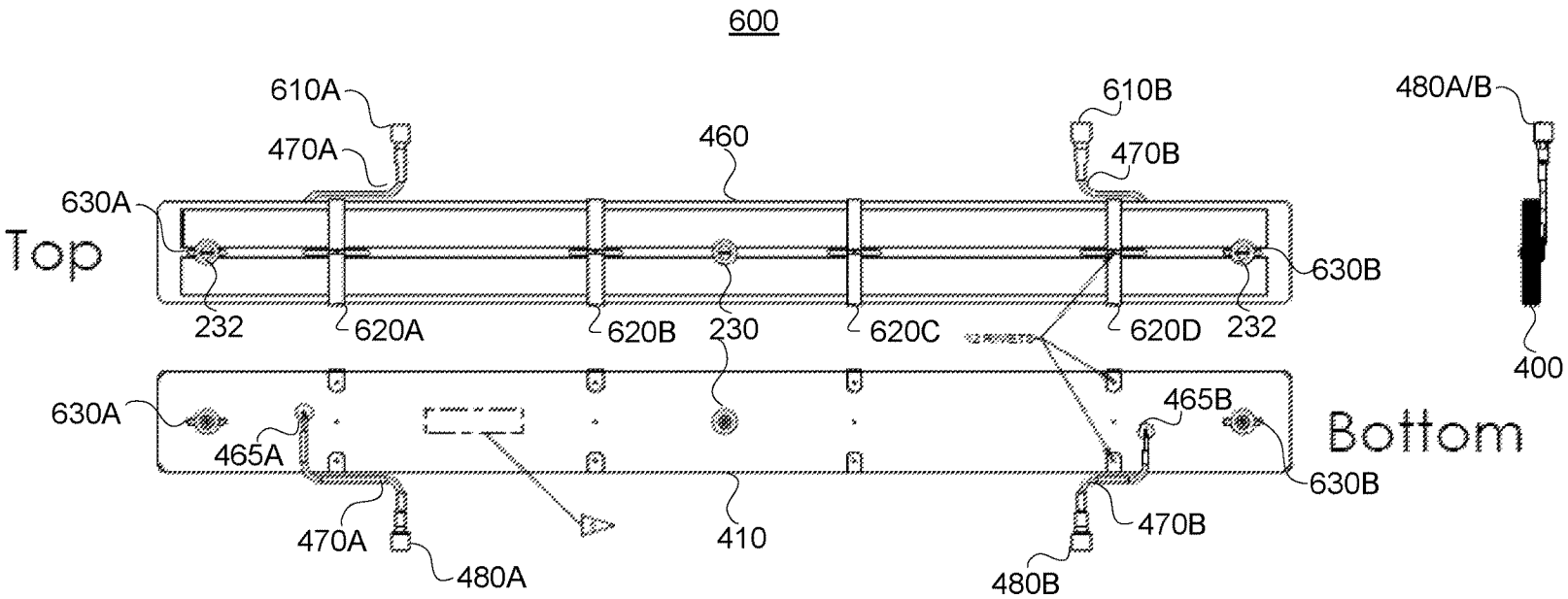
FIG. 6 depicts top and bottom views of a wearable magnetic antenna, in accordance with some example embodiments.

FIG. 6 depicts top and bottom views of a wearable magnetic antenna. The bottom view shows layer 410 described above with respect to FIG. 4. The top view shows layer 460 in FIG. 4. The description of FIG. 6 may include features described with respect to FIGS. 1-5.

At 410, connectors 480A-B, cables 470A-B, and cable ends 465A-B are shown. Anchor 230 fixes the position at the anchor of the layers in the stack with respect to one another. For example, anchor 230 may fix the relative positions of layers 410, 420, 430, 440, 450, and 460 at the position of the anchor 230. As magnetic antenna 400 is bent, the relative positions of the layers at the position of anchor 230 may not change but the relative positions of the layers may change at the ends of antenna 400. For example, as antenna 400 is bent in the shape of a belt, the outside layers of the belt travel farther than the inside layers due to an increased radius at the outside edge of the belt. To accommodate the curvature, the outside layers slide with respect to the inside layers with the aid of the lubrication layers between adjacent magnetic layers. Anchors 232 at the ends of magnetic antenna 400 hold the magnetic and lubrication layers together at the ends of magnetic antenna 400. At anchors 232 pass through slots in magnetic antenna 400. The slots accommodate the differences in length at the ends of the layers in antenna 400 as antenna 400 is bent.

The top view in FIG. 6 shows layer 460 also shown in FIG. 4. Layer 460 includes the four loops described above at 620A-D. In some example embodiments, one side of each loop may be connected to one of the power combiners/distributors shown in FIG. 5 and the other side of each loop 620A-D may connect to the other power combiner/distributor.

In implementations, various materials may be used in the above devices. For example, the antenna circuit may include Kapton: polyimide film; the antenna circuit outer cover may include a material similar to Hypalon: uPVC/Polyester; and the flexible antenna stack may include KYDEX: Acrylic-Polyvinyl Chloride alloy.

While this patent document contains many specifics, these should not be construed as limitations on the scope of any invention or of what may be claimed, but rather as descriptions of features that may be specific to particular embodiments. Certain features that are described herein in the context of separate embodiments can also be implemented in combination in a single embodiment. Various features that are described in the context of a single embodiment can also be implemented in multiple embodiments separately or in any suitable subcombination. Moreover, although features may be described above as acting in certain combinations and even initially claimed as such, one or more features from a claimed combination can be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Moreover, the separation of various system components in the embodiments described in this patent document should not be understood as requiring such separation in all embodiments.

Although a few variations have been described in detail above, other modifications or additions are possible. In particular, further features and/or variations may be provided in addition to those set forth herein. Moreover, the example embodiments described above may be directed to various combinations and subcombinations of the disclosed features and/or combinations and subcombinations of several further features disclosed above. In addition, the logic flow depicted in the accompanying figures and/or described herein does not require the particular order shown, or sequential order, to achieve desirable results. Other embodiments may be within the scope of the following claims.

Only a few implementations and examples are described and other implementations, enhancements and variations can be made based on what is described and illustrated herein.

What is claimed is:

1. A deformable magnetic antenna apparatus, comprising:

a plurality of flexible magnetic antenna layers stacked to form a layered magnetic antenna structure that is bendable, each flexible magnetic antenna layer including a magnetic material that confines a magnetic field to concentrate a magnetic flux of the magnetic field inside the magnetic antenna layer;

a lubricating material applied between adjacent flexible magnetic antenna layers to allow adjacent magnetic layers to move relative to one another when the layered magnetic antenna structure is bent so as to reduce a stress in each flexible magnetic antenna layer caused by bending the layered magnetic antenna structure;

an anchoring device inserted to fix the flexible magnetic antenna layers at one fixed location in the layered magnetic antenna structure to allow the magnetic layers to move relative to one another at locations other than the one fixed location when the layered magnetic antenna structure is bent and to prevent slippage between the flexible magnetic antenna layers while maintaining a desired overall structure of the layered magnetic antenna structure during the bending; and a transducer circuit positioned to be electromagnetically coupled to a selected location along the layered magnetic antenna structure, wherein the transducer circuit converts a combined magnetic flux in the flexible magnetic antenna layers due to an incoming antenna signal to a received antenna signal for processing, and wherein the transducer converts an antenna transmission signal to an oscillating magnetic field induced in the layered magnetic antenna structure that radiates an outgoing antenna signal.

2. The apparatus as in claim 1, wherein the transducer circuit converts the magnetic field confined in the layered magnetic antenna structure to an electric current as the received antenna signal for further processing.

3. The apparatus as in claim 1, wherein the transducer circuit converts the magnetic field confined in the layered magnetic antenna structure to an electric voltage as the received antenna signal for further processing.

4. The apparatus as in claim 1, wherein the transducer circuit converts the magnetic field confined in the layered magnetic antenna structure to an optical signal as the received antenna signal for further processing.

5. The apparatus as in claim 1, wherein the transducer circuit converts an electric current from a transmitter to the magnetic field confined in the layered magnetic antenna structure.

6. The apparatus as in claim 1, wherein the transducer circuit converts an electric voltage from a transmitter to the magnetic field confined in the layered magnetic antenna structure.

7. The apparatus as in claim 1, wherein the transducer circuit converts an optical signal from a transmitter to the magnetic field confined in the layered magnetic antenna structure.

8. The apparatus as in claim 1, wherein the magnetic material included in a flexible magnetic antenna layer is selected to exhibit a permeability including a real permeability and an imaginary permeability which is less than the real permeability.

9. The apparatus as in claim 8, wherein the magnetic material included in a flexible magnetic antenna layer is selected to exhibit have a permittivity including a real permittivity and an imaginary permittivity which is less than the real permittivity.

10. The apparatus as in claim 8, wherein the magnetic material included in a flexible magnetic antenna layer is selected to render the real permeability to be greater than a real permittivity for a wide-frequency-band operation.

11. The apparatus as in claim 1, wherein the flexible magnetic antenna layers are structured to exhibit different permeabilities, respectively.

12. The apparatus as in claim 11, wherein the flexible magnetic antenna layers are structured to exhibit alternating permeabilities.

13. The apparatus as in claim 1, further comprising one or more additional anchoring devices engaged to the flexible magnetic antenna layers, wherein each additional anchoring device is not fixed to any of the flexible magnetic antenna layers to allow each flexible magnetic antenna layer to move within a limited confined range.

14. A deformable magnetic antenna apparatus, comprising:

a plurality of flexible magnetic antenna layers stacked to form a layered magnetic antenna structure that is bendable, each flexible magnetic antenna layer including a magnetic material that confines a magnetic field to concentrate a magnetic flux of the magnetic field inside the magnetic antenna layer;

an anchoring device engaged to the flexible magnetic antenna layers to fix the flexible magnetic antenna layers at one single fixed location in each of the flexible magnetic antenna layers to allow the flexible magnetic layers to move relative to one another at locations other than the one single fixed location when the layered magnetic antenna structure is bent to prevent slippage between the flexible magnetic antenna layers and to reduce a stress in each flexible magnetic antenna layer caused by bending while maintaining a desired overall structure of the layered magnetic antenna structure during the bending; and a transducer circuit positioned to be electromagnetically coupled to a selected location along the layered magnetic antenna structure, wherein the transducer circuit converts a combined magnetic flux in the flexible magnetic antenna layers due to an incoming antenna signal to a received antenna signal for processing, and wherein the transducer converts an antenna transmission signal to an oscillating magnetic field induced in the layered magnetic antenna structure that radiates an outgoing antennal signal.

15. The apparatus as in claim 14, further comprising a lubricating material between the flexible magnetic antenna layers to allow adjacent magnetic layers to move relative to one another when the layered magnetic antenna structure is bent so as to reduce a stress in each flexible magnetic antenna layer caused by bending the layered magnetic antenna structure.

16. The apparatus as in claim 14, wherein the magnetic material included in a flexible magnetic antenna layer is selected to exhibit a permeability including a real permeability and an imaginary permeability which is less than the real permeability.

17. The apparatus as in claim 14, wherein the magnetic material included in a flexible magnetic antenna layer is selected to exhibit a permittivity including a real permittivity and an imaginary permittivity which is less than the real permittivity.

18. The apparatus as in claim 14, wherein the magnetic material included in a flexible magnetic antenna layer is selected to render the real permeability to be greater than a real permittivity for a wide-frequency-band operation.

19. The apparatus as in claim 18, wherein the flexible magnetic antenna layers are structured to exhibit alternating permeabilities.

20. The apparatus as in claim 14, wherein the flexible magnetic antenna layers are structured to exhibit different permeabilities, respectively.

21. The apparatus as in claim 14, further comprising one or more additional anchoring devices engaged to the flexible magnetic antenna layers, wherein each additional anchoring device is not fixed to any of the flexible magnetic antenna layers to allow each flexible magnetic antenna layer to move within a limited confined range.

* * * * *